US005629608A

United States Patent [19]

Budelman

[11] Patent Number: 5,629,608

[45] Date of Patent: May 13, 1997

[54] POWER REGULATION SYSTEM FOR CONTROLLING VOLTAGE EXCURSIONS

[75] Inventor: Gerald A. Budelman, Aloha, Oreg.

[73] Assignee: Intel Corporation, Santa Clara, Calif.

[21] Appl. No.: 365,367

[22] Filed: Dec. 28, 1994

[51] Int. Cl.[6] ..... G05F 1/613

[52] U.S. Cl. ..... 323/268; 323/274; 323/284

[58] Field of Search ..... 323/268, 269, 323/271, 272, 273, 274, 282, 284

[56] References Cited

U.S. PATENT DOCUMENTS

| | | | |
|---|---|---|---|
| 3,600,667 | 8/1971 | Wynn | 323/269 |
| 4,502,152 | 2/1985 | Sinclair | 323/268 |
| 4,614,906 | 9/1986 | Maxham | 323/267 |
| 4,644,251 | 2/1987 | Rathke | 323/267 |
| 4,719,404 | 1/1988 | Eksstrand | 323/268 |
| 5,034,676 | 7/1991 | Kinzalow | 323/268 |
| 5,083,078 | 1/1992 | Kubler et al. | 323/268 |
| 5,258,701 | 11/1993 | Pizzi et al. | 323/269 |
| 5,267,136 | 11/1993 | Suga et al. | 323/271 |
| 5,450,003 | 9/1995 | Cheon | 323/272 |

*Primary Examiner*—Jeffrey L. Sterrett
*Attorney, Agent, or Firm*—Blakely, Sokoloff, Taylor & Zafman

[57] ABSTRACT

An apparatus and method for providing dynamic voltage regulation for a system with a fluctuating current demand are disclosed. A first voltage regulator is used for producing regulated output to the system. A control circuit activates a second voltage regulator with faster transient response than the first voltage regulator to help source current when the first voltage regulator is unable to adequately respond to an increase in current demand from the system. The control circuit activates a load element to help sink current at the output of the first voltage regulator when the first voltage regulator is unable to adequately respond to a decrease in current demand from the system.

31 Claims, 8 Drawing Sheets

POWER REGULATION SYSTEM FOR CONTROLLING VOLTAGE EXCURSIONS

FIELD OF THE INVENTION

The present invention relates generally to circuitry for supplying regulated voltage and more particularly to such circuitry which responds rapidly to sustain the fluctuating power requirements of a load while maintaining high efficiency.

BACKGROUND OF THE INVENTION

Power supplies in the prior art include linear power supplies and switching power supplies. Linear power supplies control output voltage by controlling the voltage drop across a power transistor which is connected in series with a load. The power transistor is operated in its linear region and conducts current continuously.

Switching power supplies control output voltage by using a power transistor as a switch to provide a pulsed flow of current to a network of inductive and capacitive energy storage elements. These active elements smooth the switched current pulses into a continuous and regulated output voltage. The power transistor is usually operated either in a cutoff or saturated state at a duty cycle required by the voltage differential between the input and output voltages. Varying the duty cycle varies the regulated output voltage of the switching regulator.

Linear regulators offer a number of advantages, one of which is fast transient response. However, linear regulators suffer from the drawback of inefficiency. Power that is not consumed by the load is dissipated as heat. Switching regulators also offer a number of advantages, a primary one of which is high efficiency. Since the control element in a switching regulator is either off or saturated, there is very little power dissipation. Switching regulators, however, have the drawback of poor precision regulation. Switching regulators typically have a slow response to varying load conditions. While the switching regulator circuit response time may be optimized for a particular, non-varying output potential and range of load fluctuations, there remains a limiting minimum response time under which the switching regulation is unable to adequately respond. Adding additional capacitance to the switching regulator is not a feasible solution for maintaining dynamic voltage regulation. The number of large local capacitors that would be needed for maintaining dynamic regulation would be impractical because of size and cost restraints. Moreover, the response time of the switcher could be affected by the addition of such capacitance which would compound the problem.

The prior art alternatives mentioned above fail to provide a solution to the problem of dynamic regulation for the load demands of newer microprocessor systems. Modern processors tend to modulate their current draw very rapidly and severely. They experience the problem of change in current per unit time (Di/Dt) when there is either a sudden increase or decrease in current demand. Modern systems require higher performance through the usage of a greater number of transistors at higher operating speeds. Obviously, this increases the power dissipation requirements of these new systems. A large load demand may also require a large amount of current to power the system during a given period of time when such current supply is unavailable. Designers of modern processors are also shutting off units when they are not in use and are calling them back into play when they are needed in order to conserve power in the system. Thus, the load demand for these systems may drop suddenly, resulting in an excess of unwanted current which could lead to damaging components within the system.

Thus, a voltage regulator which is able to respond to the changing power requirements of a load and operate efficiently is needed. This regulator must be able to respond quickly both to increases and decreases in power demand. As will be seen, the present invention overcomes the drawbacks of the prior art by providing a voltage regulating apparatus and method which use a first voltage regulator which operates with high efficiently, a second voltage regulator which operates with fast transient response, a load component which sinks excess current at the load, and control circuitry for managing the operation of these three components.

SUMMARY OF THE INVENTION

The present invention relates to a voltage regulating device that has the capability to respond quickly and efficiently to the changing power requirements of a load.

In an embodiment of the invention, a primary voltage regulator is used for producing regulated output voltage to the load. A secondary voltage regulator is coupled in parallel to the primary voltage regulator. The second voltage regulator has a faster transient response than the primary voltage regulator and is activated only when the primary voltage regulator is unable to adjust the voltage adequately.

A window reference circuit is used for setting up a desirable regulated output voltage range. The regulated output voltage range can be set up to meet the voltage specifications of a microprocessor. Comparator circuitry coupled to the window reference circuit and the output of the primary voltage regulator compares the regulated output voltage from the voltage regulator with the desired regulated output voltage range. If the current demand at the load increases too rapidly for the primary voltage regulator to adjust, the regulated output voltage falls below the desired regulated output voltage range. This causes the comparator circuitry to activate the secondary voltage regulator which operates to source additional current to the load. If, however, the current demand at the load decreases too rapidly for the primary regulator to adjust, the regulated output voltage rises above the desired regulated output voltage range. This causes the comparator circuitry to activate a linear load element coupled to the output of the voltage regulating device. The linear load element operates to sink excess current to prevent damage in the system being powered by the voltage regulating device. If, however, the regulated output voltage of the primary voltage regulator is within the desirable regulated output voltage range, neither the secondary regulator or the linear load element is activated, and the regulated output voltage is sent directly to the load.

BRIEF DESCRIPTION OF THE DRAWINGS

The present invention will be understood more fully from the detailed description given below and from the accompanied drawings of the preferred embodiment of the invention. The description and drawings are not meant to limit the invention to the specific embodiment. They are provided for explanation and understanding of the present invention.

DETAILED DESCRIPTION

An apparatus and method for providing dynamic regulation across a load are disclosed. In the following description, numerous specific details, including component values and component arrangements, are set forth to provide a thorough understanding of the preferred embodiment of the present invention. It will be obvious, however, to one skilled in the art that the present invention may be practiced without these specific details. In other instances, well-known circuitry, structures, and methods have not been shown in detail in order to avoid unnecessarily obscuring the present invention.

Figure 1:
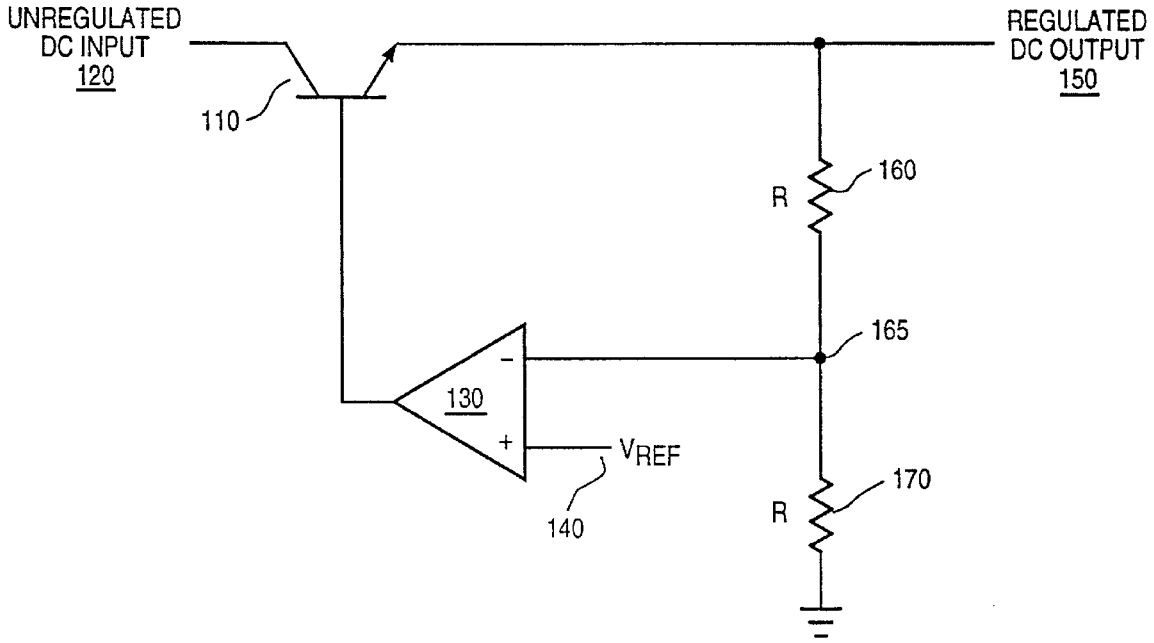
FIG 1 (PRIOR ART)
FIG. 1 illustrates a prior art linear voltage regulator.

FIG. 1 illustrates a conventional linear power regulator. A linear control element 110 (the pass transistor) is coupled in series with the unregulated dc input voltage on line 120. Feedback amplifier 130 is utilized to maintain constant output voltage. Feedback amplifier 130 compares a sampled version of the regulated output on line 165 with a voltage reference 140, Vref, applied to the input. Resistors 160 and 170 are used as a voltage divider to set the regulated voltage at the negative input of feedback amplifier 165 at a desired level. The regulated output on line 150 is controlled by linearly varying the base drive of the transistor 110. The output voltage on line 150 is always lower in voltage than the unregulated input voltage on line 120, and some power is dissipated in the control element 110.

Figure 2:
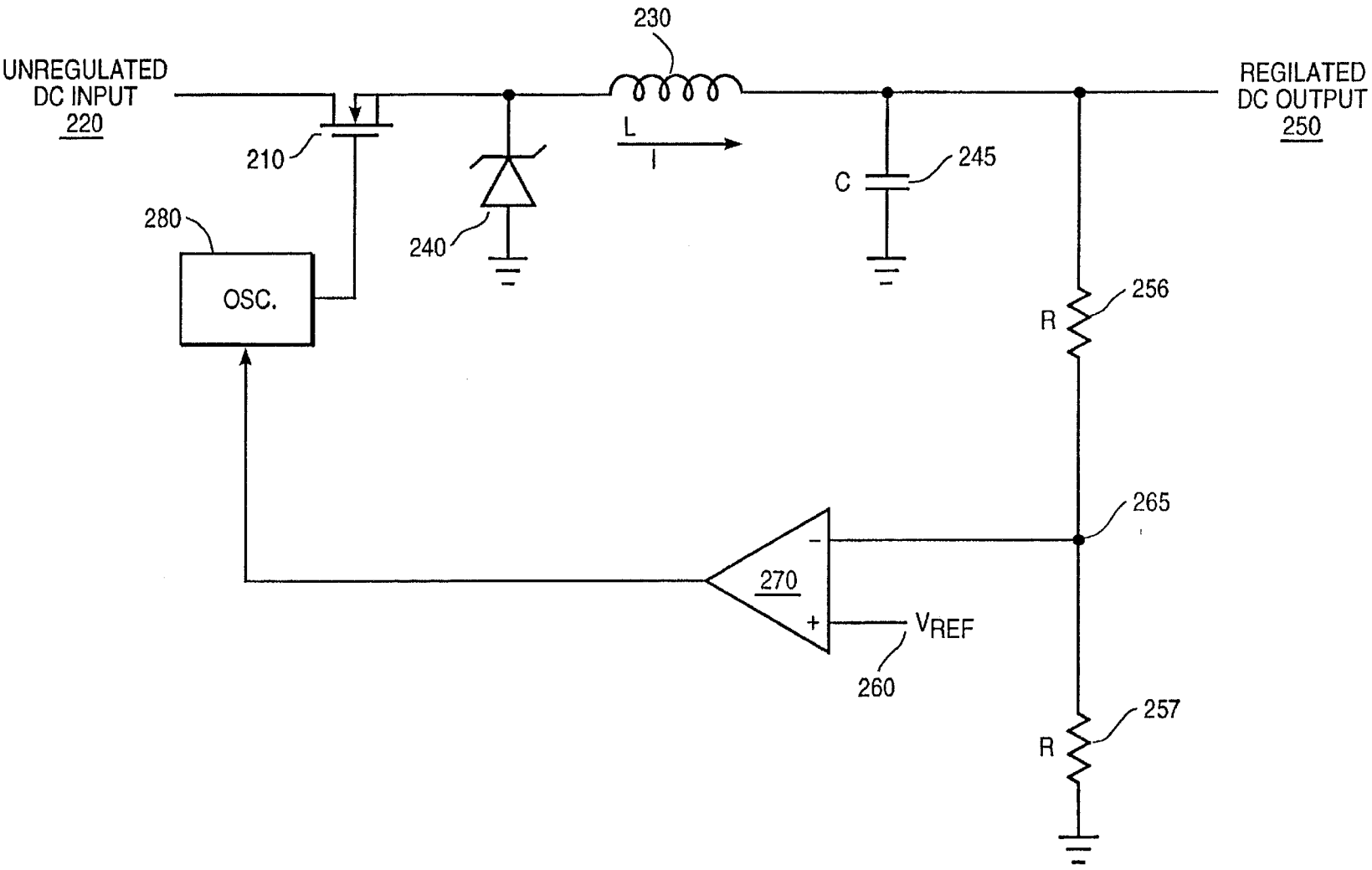
FIG. 2 (PRIOR ART)
FIG. 2 illustrates a prior art switching voltage regulator.

FIG. 2 illustrates a prior art switching power regulator. Unregulated input voltage enters the switching power regulator though line 220. Regulated output voltage is sent out at line 250. Transistor 210 operates as a saturated switch which periodically applies the full unregulated voltage on line 220 to inductor 230 for short intervals. The current (I) through inductor 230 builds up during each pulse, storing ½ $LI^2$ of energy in its magnetic field. The stored energy is transferred to a filter capacitor 245. Filter capacitor 245 is coupled to the output at line 250 and operates to smooth the output. As with the linear regulator, feedback amplifier 270 in the switching regulator compares a sampled version of the output with a voltage reference 260. Resistors 256 and 257 are used as a voltage divider to set the regulated voltage at the negative input 265 of feedback amplifier 270 at a desired level. The feedback amplifier 270 in the switching regulator controls the output by changing the oscillator's 280 pulse width or switching frequency, rather than by linearly controlling the base drive as it does in the linear regulator.

Figure 3:
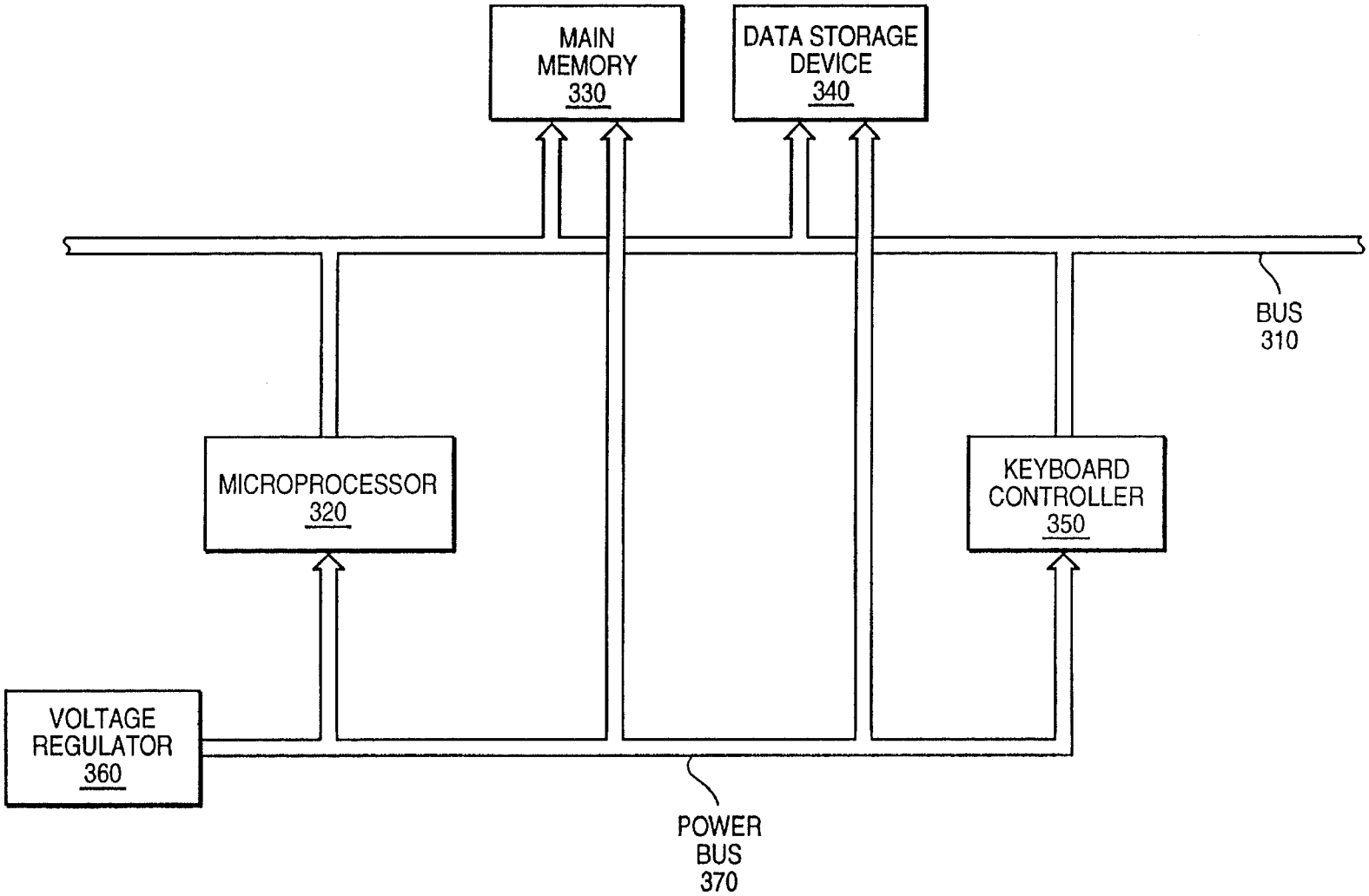
FIG. 3 illustrates a computer system configured with the voltage regulating device of the present invention.

Voltage regulators can be implemented to perform any number of functions. For example, a voltage regulator can be used in a computer system to power the processor, main memory, and mass storage device. FIG. 3 illustrates a computer system configured with the voltage regulating device of the present invention. The computer system comprises a bus 310 for transferring information. A microprocessor 320 is used for processing information and is coupled to bus 310. Main memory 330 is comprised of random excess memory (RAM) or some other dynamic storage device which is used in storing information and instructions to be executed by the microprocessor 320. Main memory 330 may also be used for storing temporary variables or other intermediate information during execution of instructions by the microprocessor 320.

The computer system also comprises a data storage device 340 such as a hard, floppy, or optical disk drive. The data storage device can be coupled to bus 310 for storing information and instructions. An alphanumeric input device 350, including alphanumeric and other keys, may also be coupled to bus 310 for communicating information to microprocessor 320.

As an example, the voltage regulator 360 supplies power to the microprocessor 320, main memory 330, data storage device 340 and keyboard controller 350 by sending a regulated voltage across power bus 370. Voltage regulator 360 takes unregulated voltage and sends it though a primary voltage regulator to be regulated. If the primary voltage regulator is unable to respond quickly enough to the increasing current demand of the load, a secondary voltage regulator is activated. The secondary voltage regulator has better transient response than the primary voltage regulator and operates to help the primary voltage regulator source current. If the primary voltage regulator is unable to respond quickly enough to the decrease in current demand of the load, a linear load is activated to help sink the excess current.

Figure 4:
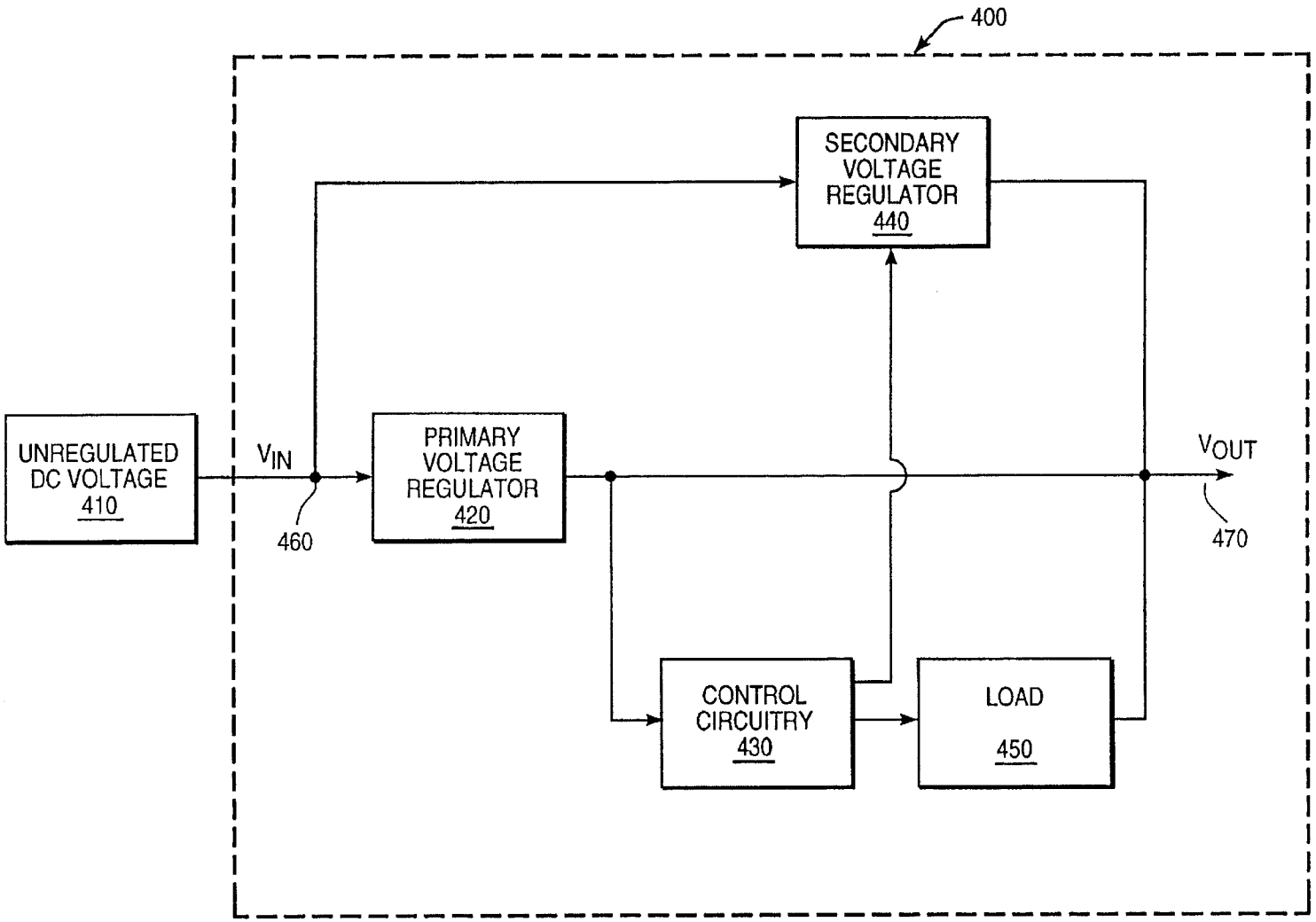
FIG. 4 is a block diagram showing one implementation of the present invention.

FIG. 4 is a block diagram of the present invention. Unregulated dc voltage 410 is coupled to voltage regulating device 400. Primary voltage regulator 420 receives the unregulated dc input and regulates the dc input according to a reference voltage in the primary voltage regulator and the load demand at Vout 470. The primary voltage regulator 420 regulates with high efficiency and has the characteristics of a switching regulator.

Control circuitry 430 is coupled to the primary voltage regulator 420. Regulated output from the primary voltage regulator 420 is sent to the control circuitry 430. Once received, the Control circuitry 430 compares the regulated output voltage from the primary voltage regulator 420 with a desired regulated output voltage range which is preset in the control circuitry 430. If the primary voltage regulator 420 is unable to respond quickly enough to the current demand at Vout 470, the regulated output voltage falls below the desired output voltage range and the control circuitry 430 activates a secondary voltage regulator 440 coupled in parallel to the primary voltage regulator 420 to source additional current. The secondary voltage regulator 440 operates with a fast transient response such as a linear regulator. The secondary voltage regulator 440 continues to source current to the load at Vout 470 until the primary voltage regulator 420 is able to meet the current demand of the load. The control circuitry 430 continues to check whether the regulated output voltage of the primary voltage regulator 420 falls within the desired regulated output voltage range. Once the primary voltage regulator is able to maintain an output voltage within the desired regulated output voltage range, the control circuitry deactivates the secondary voltage regulator.

If the primary voltage regulator 420 is unable to respond quickly enough to the decrease in current demand of the load, the regulated output voltage of the primary voltage regulator 420 rises above the desired output voltage range. Control circuitry 430 then activates a linear load element 450 coupled to the output of the voltage regulating device to help sink excess current to the load at Vout 470. This prevents the system powered by the regulator from being damaged by the excess current. Once the primary voltage regulator 420 is able to maintain an output voltage within the desired output voltage range, the control circuitry deactivates linear load element 450. Neither the secondary voltage regulator 440 nor the linear load element 450 is activated if the regulated output voltage of the primary voltage regulator is within the preset desirable output voltage range.

The control circuitry allows both a switching and a linear regulator to be implemented in the present invention. The control circuitry's management of the regulators allows the invention to achieve the transient response of a linear regulator while maintaining the efficiency of a switching regulator. Furthermore, the control circuitry utilizes the positive aspects of both regulators without incurring their negative aspects. Since, the linear regulator is activated only when the switching regulator is unable to provide adequate transient response, the duty cycle of the linear regulator is sufficiently low. Thus, the traditional problems associated with using a linear regulator, such as the requirement of using big transistors and large heat sinks, are not applicable to the present invention. In addition, the control circuitry's utilization of a linear load element provides a quick and reliable means for the invention to sink excess current, a feature not available in either switching or linear regulators.

Figure 5:
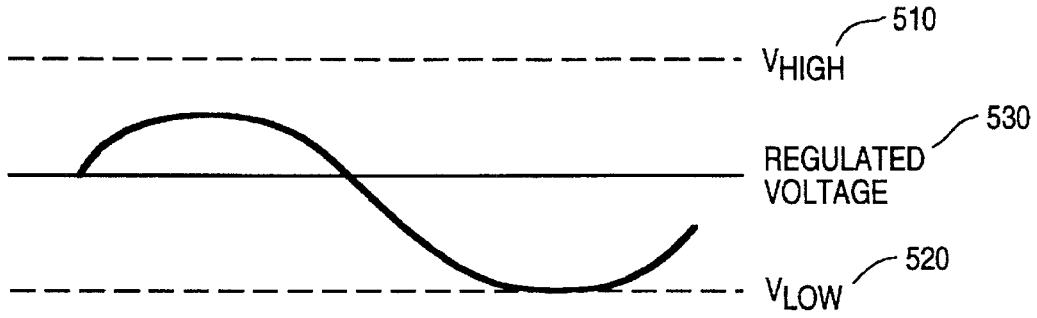
FIG. 5 illustrates the high and low value boundaries of a window reference.

The control circuitry 430 in FIG. 4 forms a window reference for the output voltage of the regulators. A conceptual illustration of the window reference is shown in FIG. 5. A high value boundary 510 and a low value boundary 520 is set so that if regulated output 530 rises above or falls below the preset boundary range, appropriate indicators are activated so that the voltage regulation devices can respond. However, if the regulated output stays within the window of the preset boundary range, no indication is given.

Figure 6:
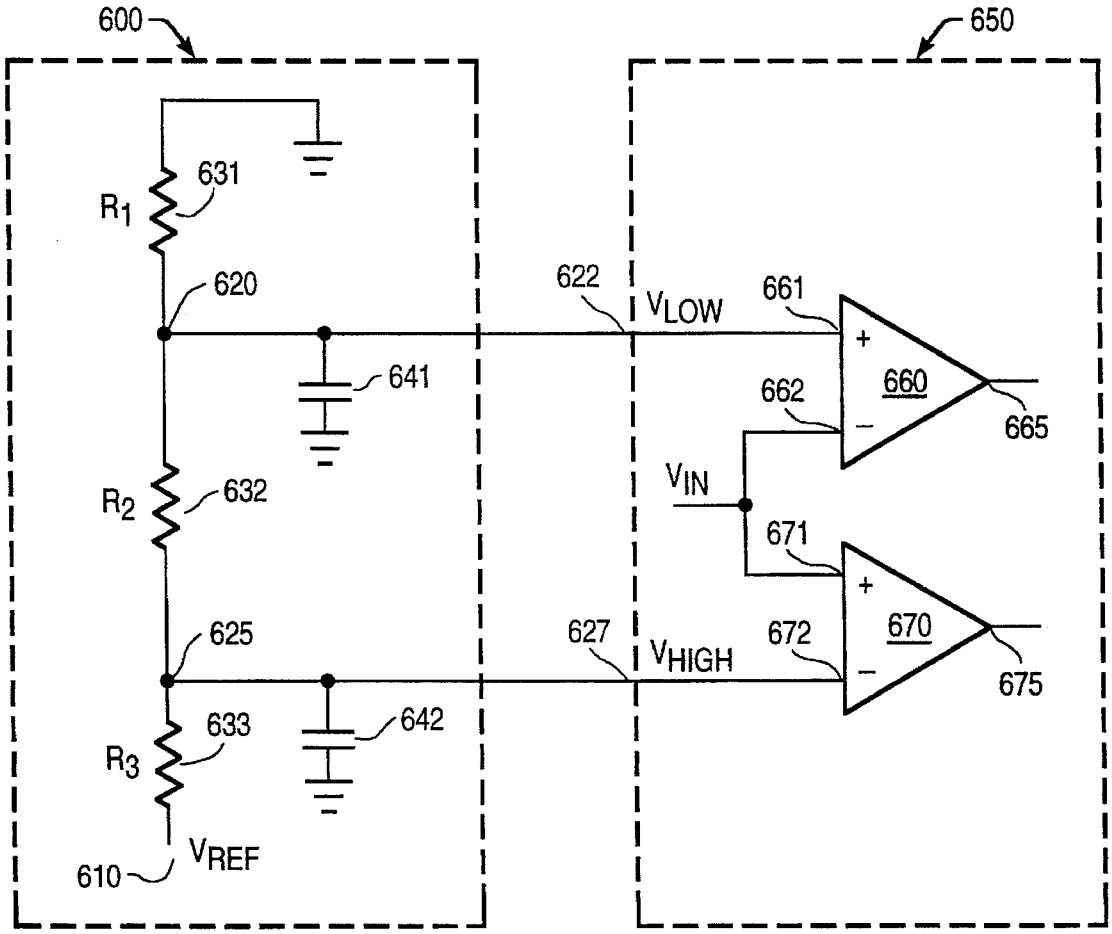
FIG. 6 illustrates the control circuitry employed in one embodiment of the present invention.

FIG. 6 illustrates the control circuitry employed in one embodiment of the present invention. The control circuitry comprises a window reference circuit 600 for setting a desired output range and comparator circuitry 650 for determining whether the regulated output from the voltage regulators are within the desired output range. The window reference circuit 600 comprises a reference voltage ($V_{ref}$) 610, a series of resistors (R1–R3) 631–633 and two capacitors 641 and 642. The comparator circuitry 650 comprises 2 operational amplifiers 660 and 670.

If, for instance, one wishes to set the output to the load at Vout at 5 volts and allow a tolerance of plus or minus 100 millivolts, the voltage reference 610 can be set at 10 volts and resistor values for resistors 631–633 are chosen to set the voltage at node 620 at 4.9 volts and node 625 at 5.1 volts. The voltages at nodes 620 and 625 are significant because the voltage level at these nodes are sent to the comparator circuitry 650 though lines 622 and 627. The comparator circuitry 650 uses these voltage levels for setting high and low value boundaries in the window reference.

The voltage at node 620 ($V_{620}$) is the value of the reference voltage 610 multiplied by the value of resistor 631 divided by the sum of all the resistor values of the resistors in series or $V_{620}=V_{ref}\times[R1/(R1+R2+R3)]$. The voltage at node 625 ($V_{625}$) is the value of the reference voltage 610 multiplied by the sum of resistor values of resistors 631 and 632 divided by the sum of all the resistor values of the resistors in series or $V_{625}=V_{ref}\times[(R1+R2)/(R1+R2+R3)]$. Thus, the value of resistors R1, R2 and R3 has the ratio 49:2:49. Capacitors 641 and 642 are utilized for maintaining the voltage at the inputs to operational amplifiers 660 and 670. Node 620 is coupled to the positive input 661 of operational amplifier 660. Node 625 is coupled to the negative input 672 of operational amplifier 670.

The comparator circuitry 650 comprises two operational amplifiers 660 and 670. Operational amplifier 660 compares the input voltage at its negative input 662 with the input voltage at its positive input 661. The input voltage at the negative input 662 of operational amplifier 660 is the regulated output voltage of the primary voltage regulator. The input voltage at the positive input 661 of operational amplifier 660 is the low boundary voltage level from line 622. If the input voltage at 662 is lower than the input voltage at 661 or in other words, if the regulated output voltage of the primary voltage regulator is lower than the low boundary voltage level, operational amplifier 660 outputs a high signal at 665.

Operational amplifier 670 compares the input voltage at its positive input 671 with the input voltage at its negative input 672. The input voltage at the positive input 671 of operational amplifier 670 is the regulated output voltage of the primary voltage regulator. The input voltage at the negative input 672 of operational amplifier 670 is the high boundary voltage level from line 627. If the input voltage at 671 is higher than the input voltage at 672 or in other words, if the regulated output voltage of the primary voltage regulator is higher than the high boundary voltage level, operational amplifier 670 outputs a high signal at 675. By the nature of the comparator circuitry, only one of the operational amplifiers outputs a high signal at any one time.

Figure 7:
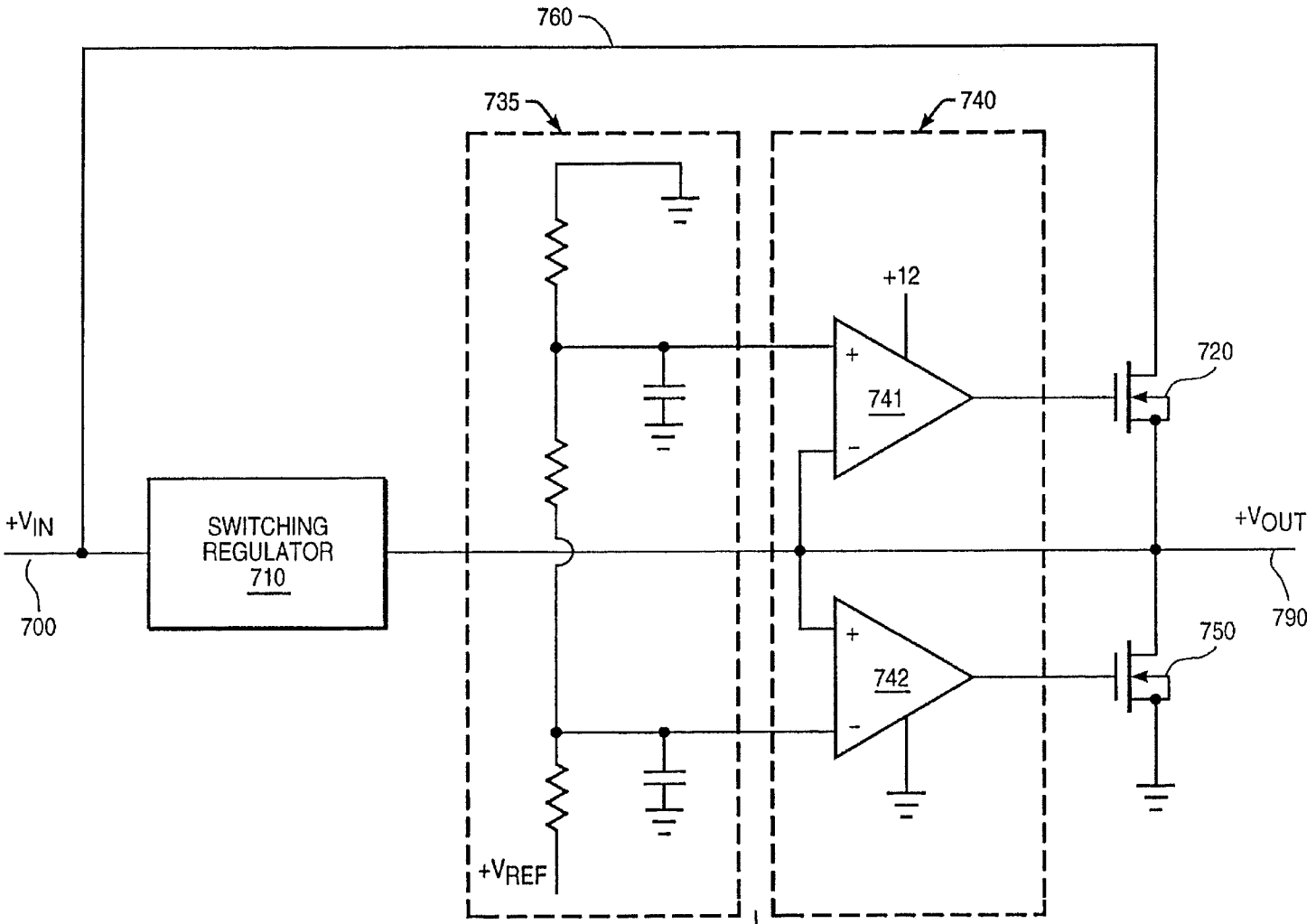
FIG. 7 is a circuit schematic diagram of one embodiment of the present invention.

FIG. 7 illustrates one embodiment of the present invention. A switching regulator 710 is implemented as the primary regulator. A linear regulator 720 coupled in parallel to the switching regulator 710 is implemented as the secondary regulator. Unregulated supply voltage is sent to linear regulator 720 from Vin on line 700 though line 760. A linear load 750 is coupled to the switching regulator 710 and comprises a transistor connected to ground. The control circuitry 730 implemented in this embodiment is similar to the control circuitry illustrated in FIG. 6. The control circuitry 730 comprises a window reference circuit 735 and comparator circuitry 740.

Unregulated dc voltage is sent to the switching regulator 710 from Vin on line 700. The switching regulator 710 regulates the dc input according to a voltage reference in the switching regulator 710 and the load demand at Vout on line 790. If there is a sudden increase in current demand at the load, the voltage at the output of the switching regulator 710 drops if it is unable to respond quickly enough to the load demand. The voltage at the output of the switching regulator 710 is sent to the comparator circuitry 740 of the control circuit 730 and is compared with preset high and low voltage levels at the window reference circuitry 735. If the voltage output of the switching regulator 710 is lower than the low preset voltage level, operational amplifier 741 sends a high input to the gate of the transistor in the linear regulator 720 which turns it on. The linear regulator 720 operates to source additional current to the load at Vout on line 790. Once the switching regulator 710 is able to adequately respond to the current demand of the load and is able to produce regulated output voltage within the range of preset voltage levels of the window reference circuit 735, operational amplifier 741 stops sending a high input to the gate of the transistor of the linear regulator 720 and the linear regulator 720 is shut off.

The linear regulator 720 is active only when the switching regulator 710 is unable to adjust the voltage according to the current demand of the load. This is a short period of time in the order of tens of microseconds. Thus, the duty cycle of the linear regulator is sufficiently low and the net efficiency of the system is not significantly effected. Since the duty cycle of the linear regulator 720 is low, the traditional requirements of linear supplies, such as utilizing big transistors and large heat sinks, do not apply to this invention.

When there is a sudden decrease in current demand, the voltage at the output of the switching regulator 710 increases if the switching regulator 710 is unable to respond quickly enough to the load's decrease in current demand. The voltage at the output of the switching regulator is sent to the comparator circuitry 740 of the control circuit 730 and compared with the preset high and low voltage levels of the window reference circuit 735. If the voltage output of the switching regulator 710 is higher than the high preset voltage level, operational amplifier 742 sends a high input to the gate of the transistor in the linear load 750 which turns it on. The linear load 750 operates to sink excess current at the output of the switching regulator to ground to prevent damage to the system being powered by the regulator. Once the switching regulator 710 is able to adequately respond to the load's decrease in current demand and is able to produce regulated output voltage within the range of preset voltage levels of the window reference circuit 735, operational amplifier 742 stops sending a high input to the gate of the transistor of the linear load 750 and the linear load 750 is shut off.

If there is neither a sudden increase or decrease in current demand and the switching regulator 710 is able to respond quickly enough to meet the current demand of the load, then neither the linear regulator 720 nor the linear load 750 is activated.

Figure 8A:
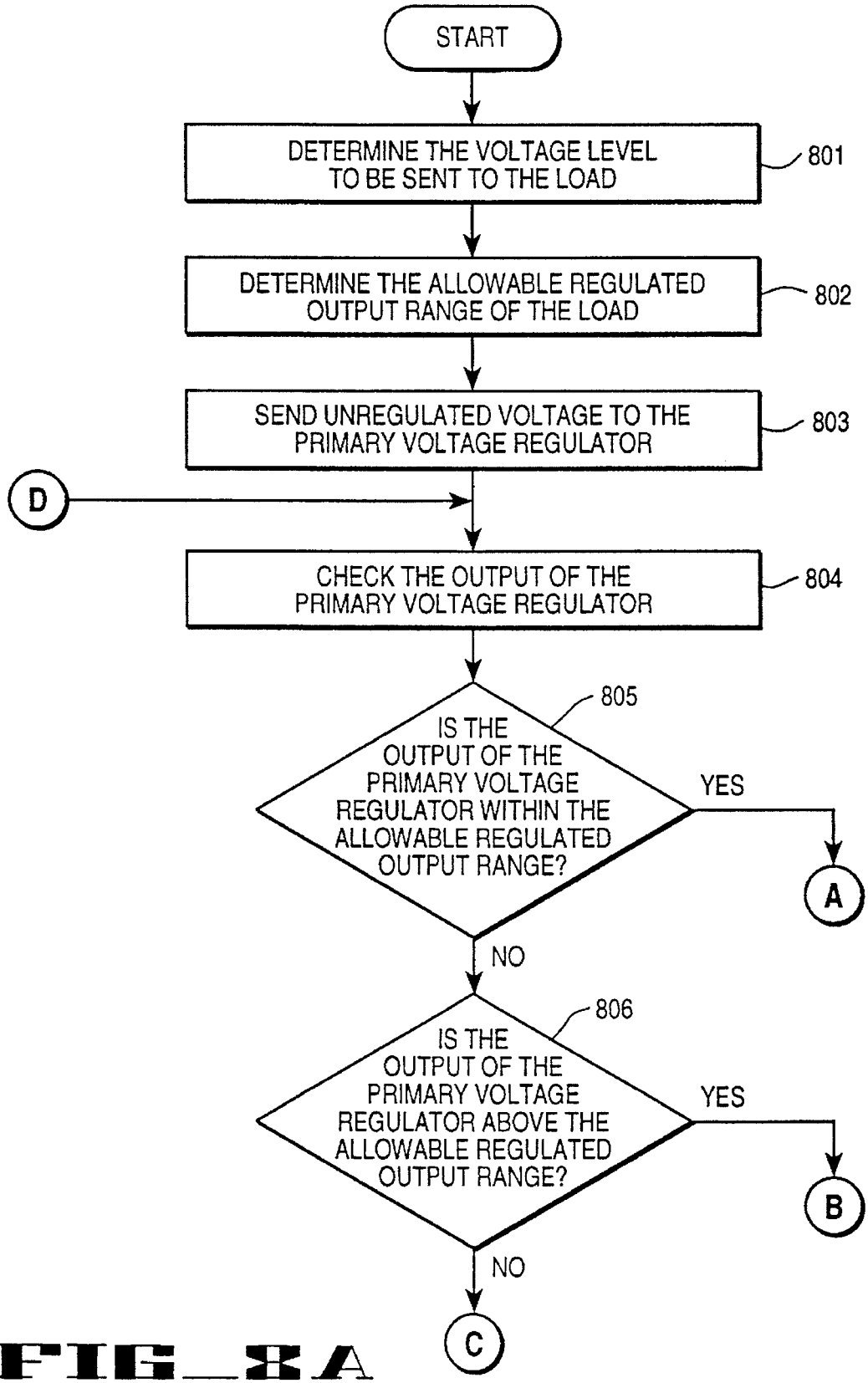
FIGS. 8*a* and 8*b* show a flow chart illustrating the steps for providing dynamic regulation across a load with a fluctuating load demand.
Figure 8B:
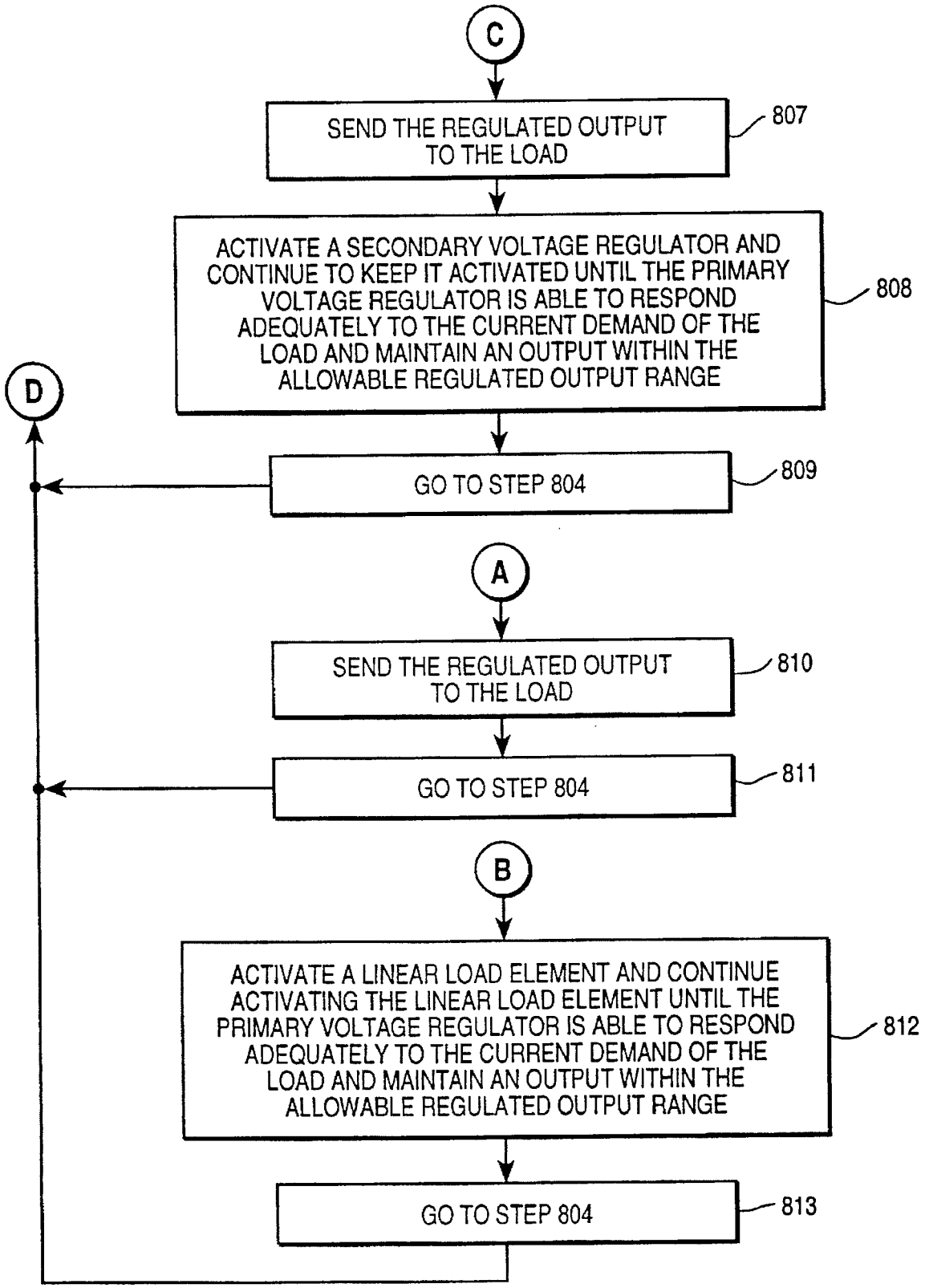

FIGS. 8*a* and 8*b* show a flow chart illustrating the steps for providing dynamic regulation across a load with a fluctuating load demand. First, determine the voltage level that is to be sent to the load, step 801. Determine the allowable regulated output voltage range where the load is operable, step 802. Send unregulated voltage to a primary voltage regulator, step 803. The primary voltage regulator regulates with high efficiency and has the characteristics of a switching regulator.

Next, check the regulated output voltage of the primary voltage regulator, step 804. Compare the regulated output voltage of the primary voltage regulator to the allowable regulated output voltage range where the load is operable, step 805. If the output voltage of the primary voltage regulator is within the allowable regulated output voltage range go to step 810. If the output voltage of the primary voltage regulator is not within the allowable regulated output voltage range go to step 806, the next step. If the output voltage of the primary voltage regulator is above the allowable regulated output voltage range go to step 812. If the output voltage of the primary voltage regulator is not above the allowable regulated output voltage range go to step 807, the next step. Send the regulated output voltage of the primary voltage regulator to the load, step 807. Activate a secondary voltage regulator to source additional current to the load. Keep the secondary voltage regulator activated until the primary voltage regulator is able to respond adequately to the current demand of the load and maintain an output voltage within the allowable regulated output voltage range, step 808. The secondary voltage regulator regulates with fast transient response and has the characteristics of a linear regulator. Go to step 804, step 809.

Step 810 requires the output voltage of the switching regulator to be sent to the load. Step 811 requires that one return back to step 804. Step 812 requires that a linear load element be activated to sink excess current at the load and to continue sinking current to the load until the primary voltage regulator is able to respond to the current demand of the load and to maintain an output voltage within the allowable regulated output voltage range. Step 813 also requires that one return back to step 804.

From the foregoing, it is recognized that the illustrated voltage regulation device and method provides the excellent regulation qualities of linear regulators while maintaining the efficiency characteristic of switching regulators.

What is claimed is:

1. An apparatus for providing voltage regulation, comprising:

a first voltage regulator that provides a regulated output voltage at an output;

a second voltage regulator, coupled in parallel to the first voltage regulator, that regulates voltage with a faster transient response than the first voltage regulator;

a load component, coupled to the output, that sinks current at the output;

a first circuit that sets an allowable regulated output voltage range; and a second circuit that compares the regulated output with the allowable regulated output voltage range and activates the second voltage regulator when the regulated output voltage is below the allowable regulated output voltage range and activates the load component when the regulated output is above the allowable output voltage range, wherein the second voltage regulator does not regulate voltage when the load component is activated.

2. The apparatus in claim 1 wherein the first voltage regulator comprises a switching regulator.

3. The apparatus in claim 1 wherein the second voltage regulator comprises a linear regulator.

4. The apparatus in claim 1 wherein the load component comprises a transistor connected to ground.

5. The apparatus in claim 1 wherein the first circuit comprises a series of resistors coupled to a reference voltage.

6. The apparatus in claim 1 wherein the second circuit comprises a double ended comparator circuit.

7. An apparatus for providing voltage regulation, comprising:

first voltage regulation means for producing a regulated output voltage at an output;

second voltage regulation means for regulating voltage at a faster transient response than the first voltage regulation means;

load means for sinking excess current from said first voltage regulation means;

a circuit for setting an allowable regulated output voltage range; and comparator means for comparing the regulated voltage with the allowable regulated output voltage range and for activating the second voltage regulation means when the regulated output voltage is below the allowable regulated output range and activating the load means when the regulated output voltage is above the allowable regulated output range, wherein the second voltage regulation means does not regulate voltage when the load means is activated.

8. The apparatus in claim 7 wherein the first voltage regulation means comprises a switching regulator.

9. The apparatus in claim 7 wherein the second voltage regulation means comprises a linear regulator.

10. The apparatus in claim 7 wherein the load means comprises a transistor connected to ground.

11. The apparatus in claim 7 wherein the first circuit comprises a series of resistors coupled to a reference voltage.

12. The apparatus in claim 7 wherein the comparator means comprises a double ended comparator circuit.

13. A computer system comprising:

a microprocessor that processes digital data;

a memory that stores digital data;

a bus coupling the microprocessor to the memory;

a voltage regulating circuit that provides dynamic voltage regulation to the computer system comprising a first voltage regulator that provides a regulated output voltage at an output, a second voltage regulator coupled in parallel to the first voltage regulator, that regulates voltage at a faster transient response than the first voltage regulator, a load component coupled to the output, a first circuit that sets an allowable regulated output voltage range, a second circuit that compares the regulated output voltage with the allowable output voltage range and that activates the second voltage regulator when the regulated output voltage is below the allowable regulated output range, and that activates the load component when the regulated output voltage is above the allowable output voltage range, wherein the second voltage regulator does not regulate voltage when the load component is activated.

14. The computer system of claim 13 wherein the first voltage regulator comprises a switching regulator.

15. The computer system of claim 13 wherein the second voltage regulator comprises a linear regulator.

16. The computer system of claim 13 wherein the load component comprises a transistor connected to ground.

17. The computer system of claim 13 wherein the first circuit comprises a series of resistors connected to a reference voltage.

18. The computer system of claim 13 wherein the second circuit comprises a double ended comparator circuit.

19. A computer system comprising:

microprocessing means for processing digital data;

memory means for storing the digital data;

bus means for coupling the processing means to the memory means;

voltage regulating means for providing dynamic voltage regulation to the computer system comprising first voltage regulation means for producing a regulated output voltage at an output, second voltage regulation means for regulating voltage at a faster transient response than the first voltage regulation means, load means for sinking excess current from the first voltage regulation means, a circuit for setting an allowable regulated output voltage range, and comparator means for comparing the regulated output voltage with the allowable regulated output voltage range and activating the second voltage regulator when the regulated output voltage is below the allowable regulated output voltage range, and activating the load means when the regulated output voltage is above the allowable regulated output voltage range, wherein the second voltage regulation means does not regulate voltage when the load means is activated.

20. The computer system of claim 19 wherein the first voltage regulation means comprises a switching regulator.

21. The computer system of claim 19 wherein the second voltage regulation means comprises a linear regulator.

22. The computer system of claim 19 wherein the load means comprises a transistor connected to ground.

23. The computer system of claim 19 wherein the first circuit comprises a series of resistors connected to a reference voltage.

24. The computer system of claim 19 wherein the comparator means comprises a double ended comparator circuit.

25. An apparatus providing dynamic voltage regulation for a computer system comprising:

a switching regulator that provides a regulated output voltage;

a linear regulator coupled in parallel to the switching regulator, a linear load coupled to the switching regulator;

a first circuit that sets an allowable regulated output voltage range for the computer system; and a second circuit that activates the linear voltage regulator when the regulated output voltage is below the allowable regulated output voltage range and that activates the linear load when the regulated output voltage is above the allowable output voltage range, wherein the linear voltage regulator does not regulate voltage when the linear load is activated.

26. A method for providing dynamic voltage regulation for an electronic system, comprising the steps of:

setting an allowable regulated output voltage range;

sending unregulated voltage to a first voltage regulator for producing a first regulated output voltage;

determining whether the regulated output voltage is within the allowable regulated output voltage range;

sending the first regulated output voltage to the electronic system if the first regulated output voltage is within the allowable regulated output voltage range;

activating a second voltage regulator if the regulated output voltage falls below the allowable regulated output voltage range, the second voltage regulator having a faster transient response than the first voltage regulator; and activating a load component if the regulated output voltage rises above the allowable regulated output range, wherein the second voltage regulator is not activated when the load component is activated.

27. The method of claim 26 wherein the first voltage regulator comprises a switching regulator.

28. The method of claim 26 wherein the second voltage regulator comprises a linear regulator.

29. The method of claim 26 wherein said checking step is accomplished by sending the regulated voltage through a double ended comparator.

30. The method of claim 26 wherein the activating steps are accomplished by sending a signal to a transistor.

31. The method of claim 26 wherein the load component comprises a transistor connected to ground.

* * * * *